US011619079B2

(12) United States Patent
Linden et al.

(10) Patent No.: US 11,619,079 B2
(45) Date of Patent: Apr. 4, 2023

(54) VEHICLE POWERED CLOSURE HANDLE ASSEMBLY AND POWERED CLOSURE ACTUATING METHOD

(71) Applicant: Ford Global Technologies, LLC, Dearborn, MI (US)

(72) Inventors: Howard Paul Tsvi Linden, Southfield, MI (US); Onoyom Essien Ekanem, White Lake, MI (US); Constantin Manolescu, Rochester Hills, MI (US); Marc Beeman, Grosse Pointe Woods, MI (US); Rafic Jergess, Warren, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 474 days.

(21) Appl. No.: 16/707,269

(22) Filed: Dec. 9, 2019

(65) Prior Publication Data

US 2021/0172217 A1 Jun. 10, 2021

(51) Int. Cl.

| | |
|---|---|
| ***E05B 81/78*** | (2014.01) |
| ***E05B 81/76*** | (2014.01) |
| ***E05B 85/10*** | (2014.01) |
| ***E05B 79/06*** | (2014.01) |
| *E05F 15/73* | (2015.01) |

(52) U.S. Cl.

CPC ..... *E05B 81/78* (2013.01); *E05B 79/06* (2013.01); *E05B 81/77* (2013.01); *E05B 85/10* (2013.01); *E05F 15/73* (2015.01); *E05Y 2400/44* (2013.01); *E05Y 2900/531* (2013.01); *E05Y 2900/55* (2013.01)

(58) Field of Classification Search

CPC ..... E05B 81/78; E05B 79/06; E05B 81/77; E05B 85/10; E05B 81/76; E05B 81/20; E05B 17/0025; E05B 79/04; E05F 15/00; E05F 15/70; B60R 2325/105; H03K 17/9625; G01L 1/00

See application file for complete search history.

(56) References Cited

U.S. PATENT DOCUMENTS 2,307,674 A * 1/1943 Greig ..... E05B 85/22 292/169.11
2,560,477 A * 7/1951 Roethel ..... E05B 1/0038 292/336.3

(Continued)

FOREIGN PATENT DOCUMENTS

CN 106050019 A * 10/2016 ..... E05B 85/12
DE 10208573 A1 * 9/2003 ..... G01S 13/88

(Continued)

*Primary Examiner* — Kristina R Fulton
*Assistant Examiner* — Emily G. Brown
(74) *Attorney, Agent, or Firm* — Vichit Chea; Carlson, Gaskey & Olds, P.C.

(57) ABSTRACT

A vehicle handle assembly includes, among other things, an attachment bracket secured to a powered closure assembly of a vehicle, a handle core that is mounted to the attachment bracket, and a switch mounted to the handle core. The switch is configured to transition from a first state to a second state in response to a user grasping the handle core. The powered closure assembly can move between a first position and a different, second position in response to a transition of the switch.

15 Claims, 4 Drawing Sheets

(56) References Cited

U.S. PATENT DOCUMENTS

| | | | | |
|---|---|---|---|---|
| 4,867,501 | A * | 9/1989 | Nomura | E05B 85/10 292/336.3 |
| 6,740,834 | B2 * | 5/2004 | Sueyoshi | B60R 25/246 200/293.1 |
| 8,701,353 | B2 * | 4/2014 | Patel | E05B 85/103 292/201 |
| 9,156,335 | B1 * | 10/2015 | Harter | E05B 81/64 |
| 9,353,566 | B2 * | 5/2016 | Miu | B60J 5/0472 |
| 9,922,472 | B2 * | 3/2018 | Jergess | G08B 5/36 |
| 10,030,431 | B2 * | 7/2018 | Elie | E05F 15/70 |
| 10,053,893 | B1 | 8/2018 | Patel et al. | |
| 10,099,540 | B2 * | 10/2018 | Vazquez Orpinel | E05B 17/181 |
| 10,975,601 | B2 * | 4/2021 | Beck | E05B 1/0015 |
| 2004/0257296 | A1 * | 12/2004 | Ieda | B60R 25/245 340/5.72 |
| 2018/0238099 | A1 | 8/2018 | Schatz et al. | |
| 2020/0011096 | A1 * | 1/2020 | Leonardi | G01L 5/22 |

FOREIGN PATENT DOCUMENTS

| | | | | |
|---|---|---|---|---|
| DE | 102006018287 | A1 * | 10/2007 | B07C 5/342 |
| DE | 102016220084 | A1 * | 4/2018 | |
| EP | 1103432 | B1 | 2/2005 | |
| EP | 1681200 | A2 * | 7/2006 | B60N 3/023 |
| GB | 2541549 | A * | 2/2017 | B60J 5/00 |

* cited by examiner

VEHICLE POWERED CLOSURE HANDLE ASSEMBLY AND POWERED CLOSURE ACTUATING METHOD

TECHNICAL FIELD

This disclosure relates generally to a vehicle handle assembly and, more particularly, to a vehicle handle assembly for a powered closure assembly, such as a door moveable between open and closed positions by an actuator.

BACKGROUND

Vehicles typically include closure assemblies, such as doors, tailgates, liftgates, etc. The closure assemblies are moveable between open and closed positions. Some vehicles include powered closure assemblies that can be automatically moved between open and closed positions by an actuator.

SUMMARY

A vehicle handle assembly according to an exemplary aspect of the present disclosure includes, among other things, an attachment bracket secured to a powered closure assembly of a vehicle, a handle core that is mounted to the attachment bracket, and a switch mounted to the handle core. The switch is configured to transition from a first state to a second state in response to a user grasping the handle core. The powered closure assembly can move between a first position and a different, second position in response to a transition of the switch.

In another example of the foregoing handle assembly, a vehicle side door is the powered closure assembly.

In another example of any of the foregoing handle assemblies, the vehicle side door includes a panel. The attachment bracket is hooked over a vertically upper edge of the panel.

Another example of any of the foregoing handle assemblies, includes an actuator that moves the vehicle side door from the first position and the different, second position in response to the switch transitioning from the first state to the second state.

In another example of any of the foregoing handle assemblies, the vehicle side door defines a window opening between a forward pillar portion and a rear pillar portion. The vehicle side door further includes a belt molding disposed vertically below the window opening. The handle core is vertically aligned with the belt molding.

Another example of any of the foregoing handle assemblies includes an antenna module disposed in the forward pillar portion or the rear pillar portion. The antenna module is configured to detect a signal from an authorized device.

In another example of any of the foregoing handle assemblies, the handle core includes an opening extending from a vertically upward facing surface of the handle core to a vertically downward facing surface of the handle core.

In another example of any of the foregoing handle assemblies, the handle core extends about an entire circumferential perimeter of the opening.

In another example of any of the foregoing handle assemblies, the switch is a load cell switch.

Another example of any of the foregoing handle assemblies includes a handle cover that is secured to the handle core to enclose the at least one switch in a cavity between the handle cover and the handle core.

Another example of any of the foregoing handle assemblies includes a RADAR sensor assembly within the cavity.

In another example of any of the foregoing handle assemblies, the handle core is entirely a polymer-based material.

In another example of any of the foregoing handle assemblies, the attachment bracket is entirely a metal or metal alloy.

In another example of any of the foregoing handle assemblies, the handle core is overmolded to the attachment bracket.

A vehicle powered closure actuating method according to another exemplary aspect of the present disclosure includes providing a switch mounted to a handle core. The handle core is mounted to an attachment bracket that is secured to a powered closure assembly of a vehicle. The method further includes transitioning the switch from a first state to a second state in response to a user grasping the handle core, and, in response to the transitioning, initiating a powered movement of the powered closure assembly between a less open position and a more open position.

In another example of the foregoing method, the powered closure assembly is a vehicle side door.

In another example of any of the foregoing methods, the vehicle side door defines a window opening between a forward pillar portion and a rear pillar portion. The vehicle side door further includes a belt molding disposed vertically below the window opening. The handle core is vertically aligned with the belt molding.

In another example of any of the foregoing methods, the switch comprises a load cell switch.

In another example of any of the foregoing methods, the handle core includes an opening extending from a vertically upward facing surface of the handle core to a vertically downward facing surface of the handle core. The load cell switch transitions in response to a user applying pressure to a side of the handle core that faces the opening.

In another example of any of the foregoing methods, the handle core extends about an entire circumferential perimeter of the opening.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a handle assembly for a powered closure assembly of a vehicle, such as a side door of a vehicle. The handle assembly can include a switch that triggers a powered movement of the powered closure assembly. The handle assembly can further include a radar sensor.

Figure 1:
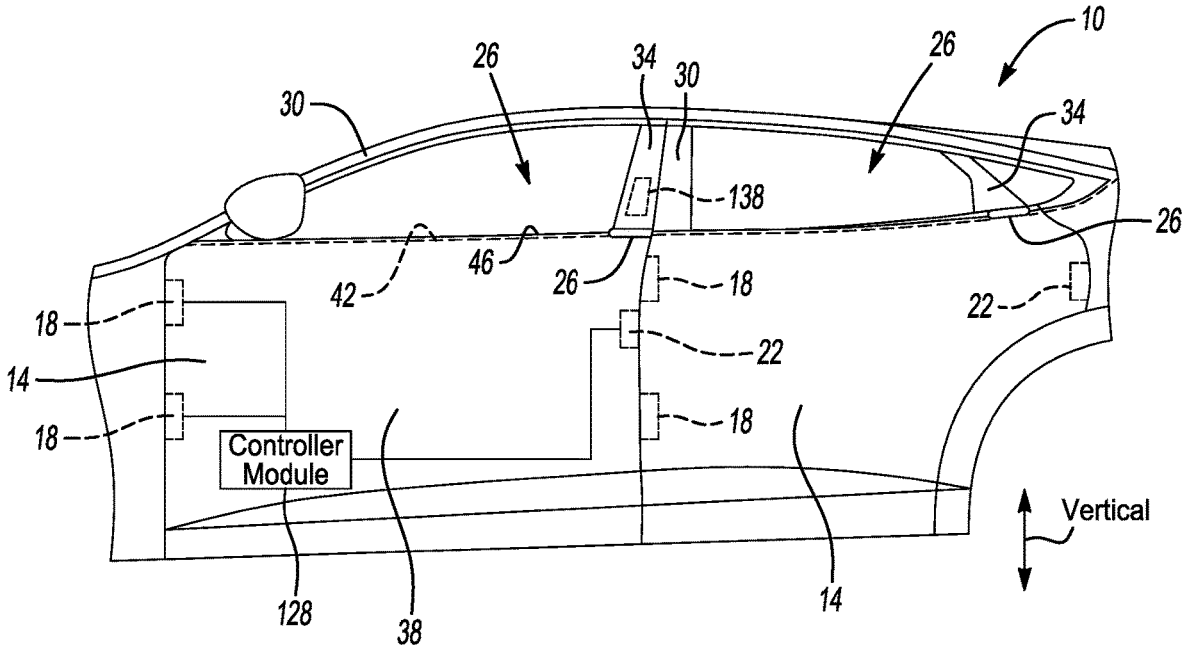
FIG. 1 illustrates a partial side and schematic view of a vehicle having a plurality of powered closure assemblies.

With reference to FIG. 1, a vehicle 10 includes a plurality of powered closure assemblies 14. In the exemplary embodiment, the powered closure assemblies 14 are side doors. In other embodiments, the powered closure assemblies 14 could be liftgates, tailgates, or another type of powered closure assembly.

Figure 2:
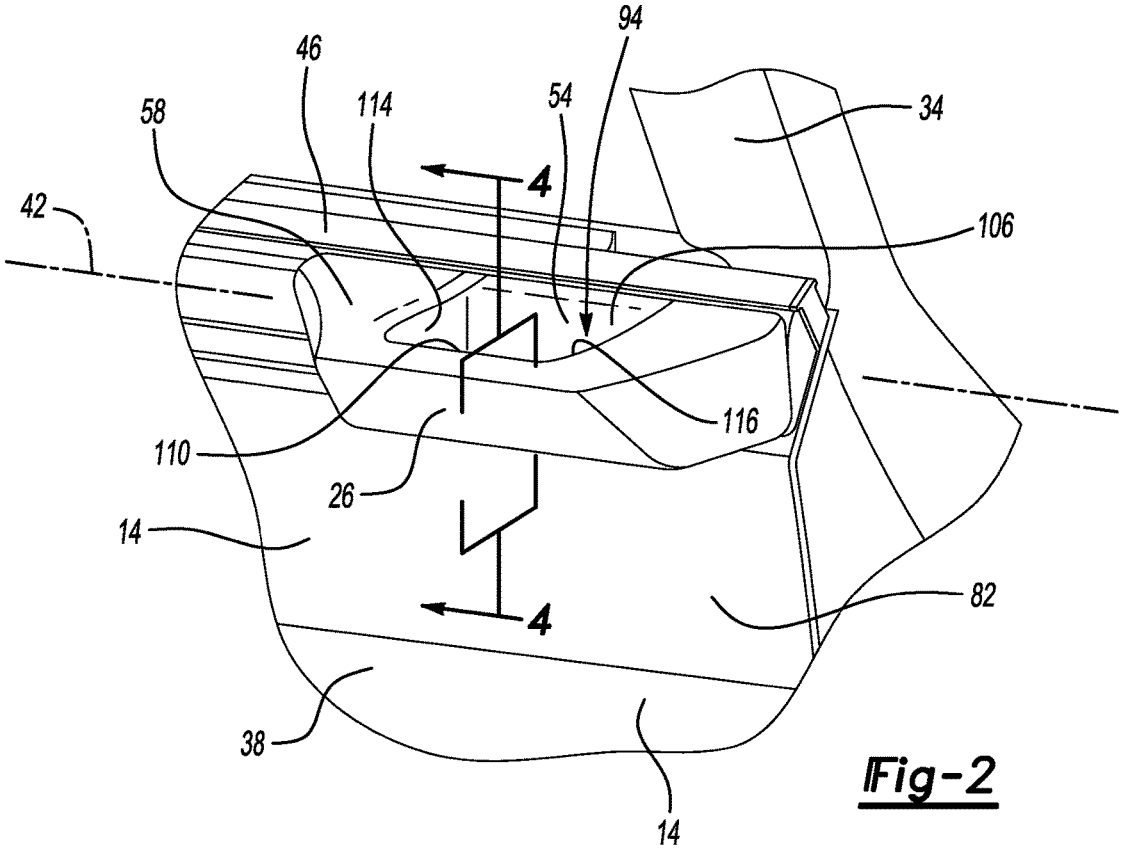
FIG. 2 illustrates a top perspective view of a vehicle handle assembly from the vehicle of FIG. 1.
Figure 3:
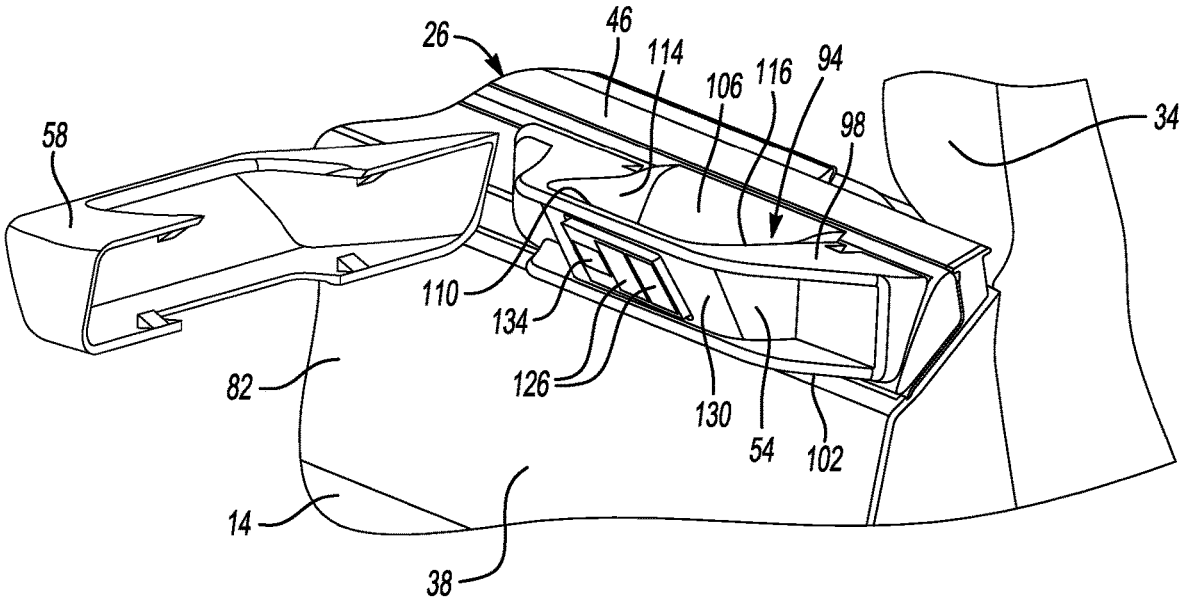
FIG. 3 illustrates the top perspective view of the vehicle handle assembly in FIG. 2 with a handle cover of the vehicle handle assembly removed.
Figure 4:
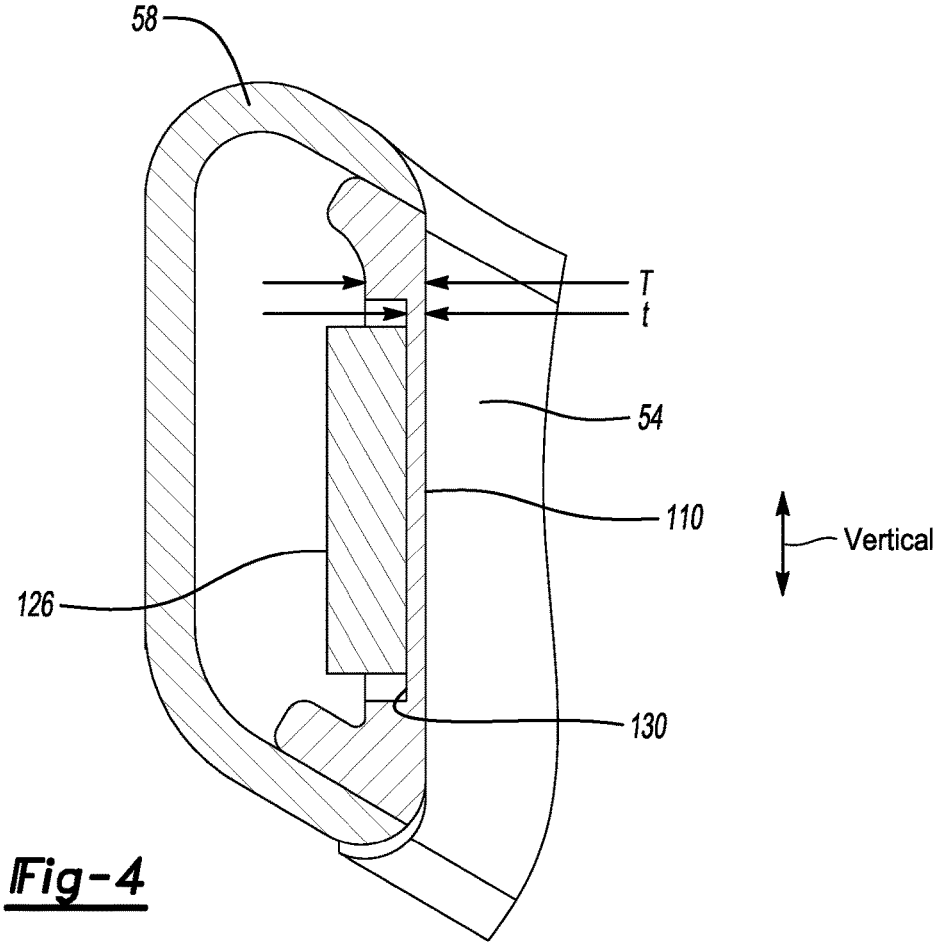
FIG. 4 illustrates a section view at line 4-4 in FIG. 2.
Figure 5:
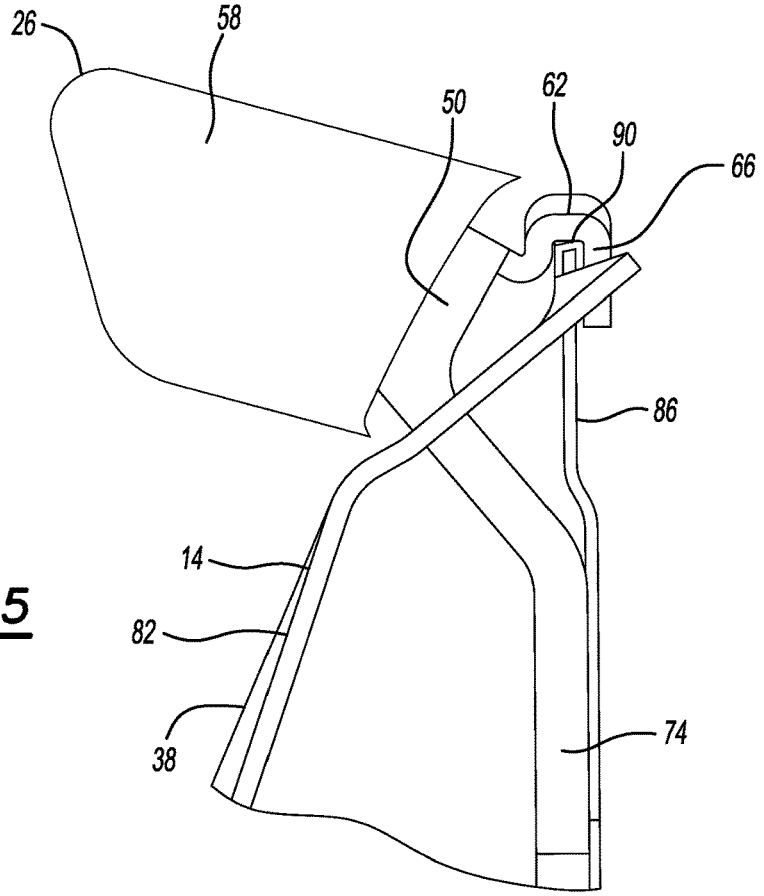
FIG. 5 illustrates an end view of the vehicle handle assembly of FIG. 2 with the associated powered closure assembly shown in section.
Figure 6:
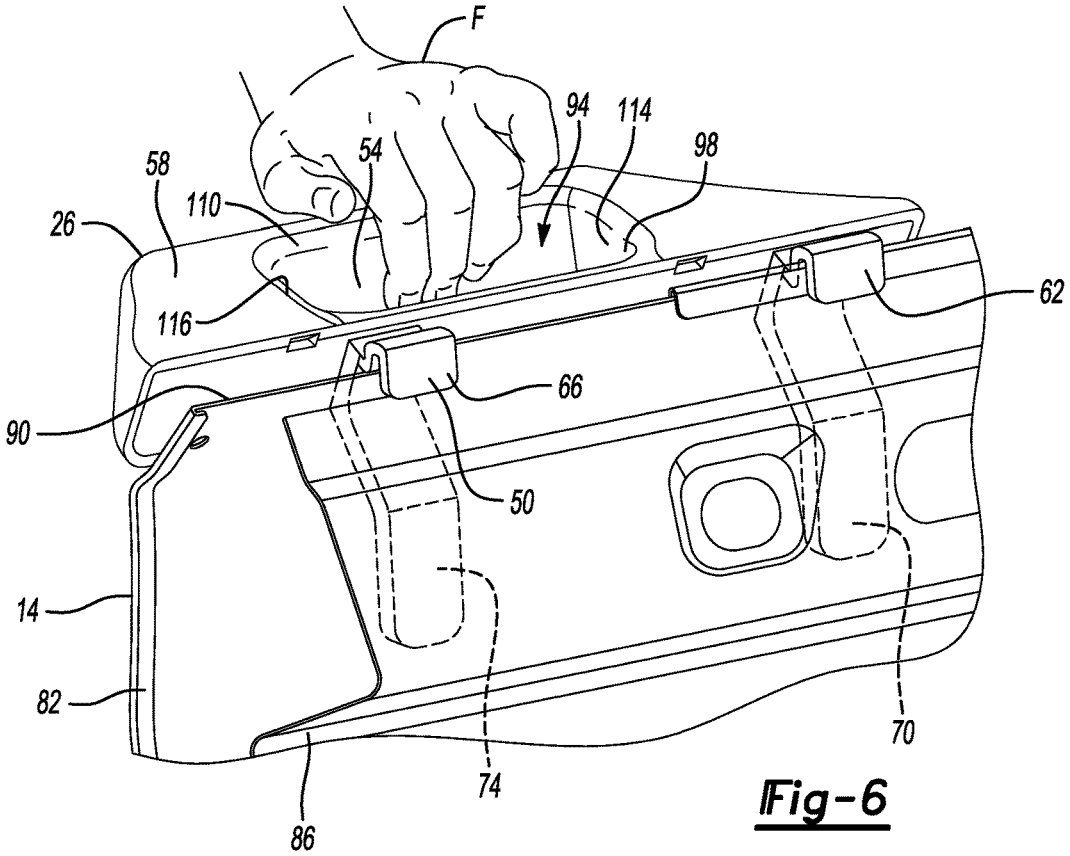
FIG. 6 illustrates a top view of the vehicle handle assembly and portions of the associated powered closure assembly looking out from within a passenger cabin of the vehicle.
Figure 7:
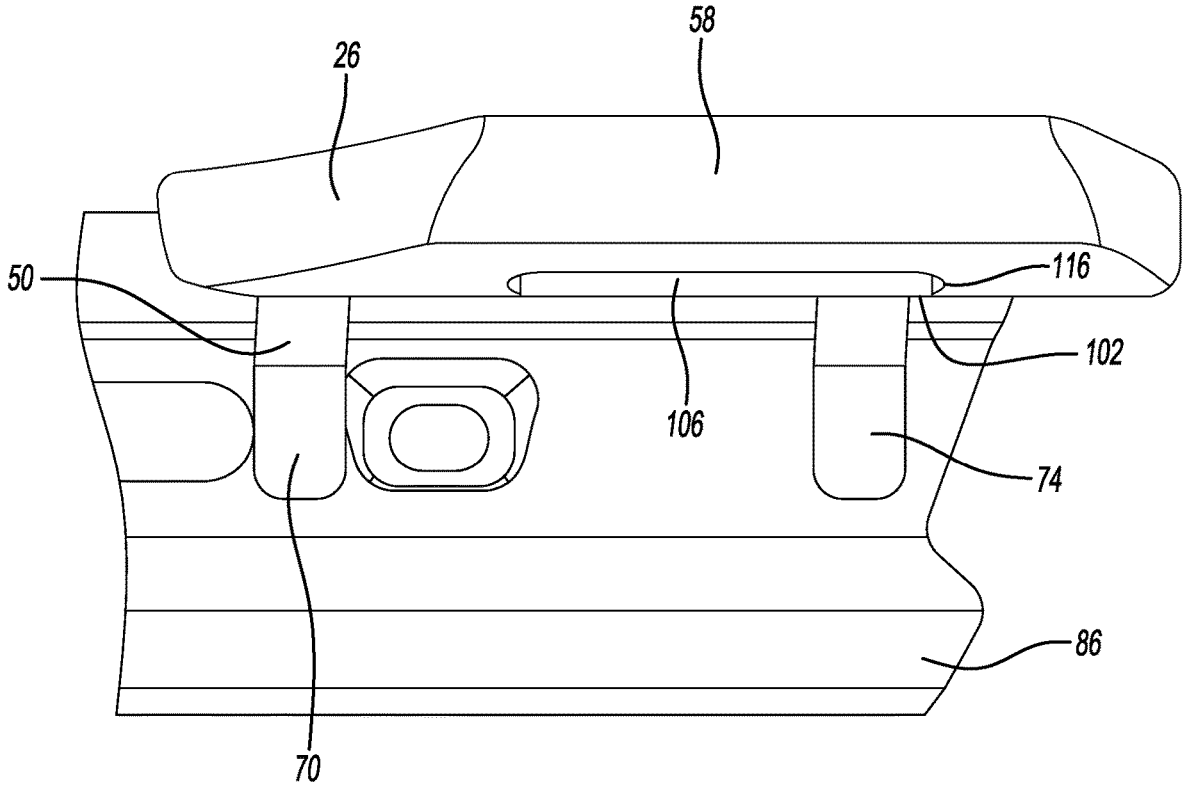
FIG. 7 illustrates a side view of the vehicle handle assembly and portions of the associated powered closure assembly.

The powered closure assemblies 14 can each move back and forth between a closed position shown in FIG. 2 and an open position. A user can access a passenger compartment of the vehicle 10 when the powered closure assemblies in in the fully open position.

The movement of the powered closure assemblies 14 can be powered. One or more actuators 18, such as powered hinges, can be used to move the powered closure assemblies 14 between the open and closed positions.

The powered closure assemblies 14 can be latched to a body portion of the vehicle 10 when in the closed position. Prior to moving one of the powered closure assemblies 14, the powered closure assembly 14 can be unlatched. Electronic latches 22 can be used to latch and unlatch the powered closure assemblies 14.

Conventional closure assemblies of the prior art, such as prior art side doors, rely on mechanical latches to hold the prior art side doors in latched positions. The mechanical latches are unlatched when a user pulls a mechanical handle to pull a latch release cable. Prior art side doors are then moveable between open and closed positions by forces applied by the user to the mechanical handle. The prior art conventional side doors are not moved by an actuator.

A vehicle handle assembly 26, in the exemplary embodiment, is secured to each of the powered closure assemblies 14. A user can grasp the vehicle handle assembly 26 to initiate a powered movement of the associated powered closure assembly 14 between the open and closed positions.

If required, the user can apply force to the vehicle handle assembly to manually move the associated powered closure assembly 14 between the open and the closed positions. Manual movement may be required if the actuators 18 are unable to initiate a powered movement of the associated power closure assembly 14. The actuators 18 may be unable to move the associated power closure assembly 14 if the vehicle is parked on an incline, or if the latch 22 is frozen, for example.

The powered closure assemblies 14, in the exemplary embodiment, each define a window opening 26 between a forward pillar portion 30 and a rear pillar portion 34. Vertically below the window opening 26 is a lower door portion 38. A beltline 42 of the vehicle 10 is vertically between the lower door portion 38 and the window opening 26. Vertical, for purposes of this disclosure, is with reference to ground and the ordinary orientation of the vehicle 10 during operation.

Belt moldings 46 of the powered closure assemblies 14 are disposed at the beltline 42. The vehicle handle assemblies 26 are also disposed at the beltline 42. The vehicle handle assemblies 26 are thus vertically aligned with the belt moldings 46 at a position that is directly vertically beneath the window opening 26. Positioning the vehicle handle assemblies 26 at the beltline 42 rather than, for example, further downward within the lower door portions 38 may be desirable for, among other things, aesthetics.

With reference now to FIGS. 2-6, the vehicle handle assembly 26, in the exemplary embodiment, includes an attachment bracket 50, a handle core 54, and a handle cover 58. The vehicle handle assembly 26 extends vertically upward moving laterally outward from a centerline of the vehicle 10. This upward tilt can facilitate hand clearance when a user grasps the vehicle handle assembly 26.

The attachment bracket 50, in the exemplary embodiment, is a metal or metal alloy. The attachment bracket 50 includes a first hook 62 and a second hook 66 that is horizontally spaced from the first hook 62. A first tab portion 70 extends vertically downward from the first hook 62. A second tab portion 74 extends vertically downward from the second hook 66.

The lower door portions 38 include an outer panel 82 and a reinforcement brace 86. The first hook 62 and the second hook 66 of the attachment bracket 50 hook over a vertically uppermost edge 90 of the outer panel 82 to help secure the vehicle handle assembly 26 to the powered closure assembly 14. The first tab portion 70 and second tab portion 74 can be welded or otherwise secured to the reinforcement brace 86 to further help secure the vehicle handle assembly 26 to the powered closure assembly 14. The reinforcement brace 86 can be a belt reinforcement metal stamping of the powered closure assembly 14. Some of the handle core 54 can pass through an opening in the reinforcement brace 86.

In the exemplary embodiment, the handle core 54 is a polymer-based material. The handle core 54 can be glass-filled.

The handle core 54 is overmolded about portions of attachment bracket 50 to mount the handle core 54 to the attachment bracket 50.

The handle core 54 includes an opening 94 extending from a vertically upward facing surface 98 of the handle core 54 to a vertically downward facing surface 102 of the handle core 54. The user can place their fingers into the opening 94 when grasping the vehicle handle assembly 26.

In this example, the handle core 54 provides an entire circumferential perimeter of the opening 94. In another example, the opening 94 is partially open, or has a portion of its perimeter provided by a structure other than the handle core 54.

The opening 94 is provided by an inner wall 106, an outer wall 110, a forward wall 114, and a rear wall 118 of the handle core 54. As can be appreciated fingers F of the user contact and apply pressure to, primarily, the outer wall 110 of the handle core 54 when the user is pulling on the vehicle handle assembly 26 to initiate movement of the powered closure assembly 14.

The vehicle handle assembly 26, in the exemplary embodiment, detects forces applied to the handle core 54 by the user, and particularly forces applied to the outer wall 110 by the fingers F of the user.

When such forces are detected, one or more switches 126 transitions from a first state to a different, second state. The switches 126 thus transition from a first state to a second state in response to the user grasping the vehicle handle assembly 26.

In response to the transition of the switches 126, a controller module 128 of the vehicle 10 can command the actuators 18 (FIG. 1) to move the powered closure assembly 14. The controller module 128 is operably coupled to the actuator 18 and the switches 126.

The controller module 128 can be a dedicated controller for the powered closure assemblies 14, part of a vehicle controller, or part of other control systems within the vehicle 10. Further, the location of the controller module 128 is shown schematically—the controller module 128 may be disposed in other locations within the vehicle 10.

In the exemplary embodiment, the switches 126 are load cell switches that to detect forces applied to the outer wall 110 by the user. Other types of switches could be used in other examples, such a capacitive based switches. The vehicle handle assembly 26 uses the load cell switches to detect pressure applied to the outer wall 110. When the load cell switches detect no load on the outer wall 110 or a load below a threshold load, the load cell switches provide an output signal to the controller module 128 that the controller module 128 interprets as the load cell switches being in a first state, When the load cell switches detect a load at or above the threshold load, the signal from the load cell switches changes. The controller module 128 interprets the change in the signal as the load cell switches being transitioned to a second state.

The vehicle handle assembly 26 of the exemplary embodiment includes two micro load cell switches mounted on a printed circuit board. The printed circuit board and load cell switches are adhesively secured to an outwardly facing surface 130 of the outer wall 110.

Where the printed circuit board and load cell switches are secured to the outer wall 110, the outer wall 110 can be thinned and scored to encourage flexing of the outer wall 110 in response to pressure applied by the user. As an example of the thinning, a thickness T (FIG. 4) of the outer wall 110 can be from between four and five millimeters, but a thickness t, where the printed circuit board and load cell switches are secured, is two millimeters thick. The outer wall 110 can include slight protrusions, say 1 millimeter protrusions, projecting into the opening. The protrusions can help to ensure contact with the user's fingers F and provide tactile feedback to the user.

In some examples, the controller module 128 signals the latch 22 to unlatch and signals the actuator 18 to begin moving the power closure assembly 14 to an open position in response to the load cell switches detecting a force applied to the outer wall 110 that is from three to six newtons.

The load cell switches can be relatively small thin, say from four to six millimeters in diameter. In a specific example, the load cell switches have a five millimeter diameter. Keeping the load cell switches small can facilitate incorporating the load cell switches into the vehicle handle assembly 26 without substantially increasing a size of the vehicle handle assembly 26.

Using the load cell switches can help the control module differentiate between loads applied by, for example, falling rain and loads applied by the user desiring to move the powered closure assembly 14. The loads applied to the outer wall 110 by the user will likely be more localized than loads due to rain. Loads associated with rain will be more generalized over a larger area and have a different pressure to time curve. If rain or freezing temperatures are detected, the control module may increase the threshold load required to interpret the load cell switch as having transitioned from the first state to the second state.

The example vehicle includes four side doors and four vehicle handle assemblies 26. The switches 126 in each of the vehicle handle assemblies 26 are in communication with the controller module 128, which can further help to guard against the controller module 128 detecting inadvertent switch transitions. For example, if it is raining or the vehicle 10 is in a carwash, all the of the vehicle handle assemblies 26 will face similar loads due to the rain. The controller module 128 can consider such a simultaneous loading as loading due to rain as it is highly unlikely that all four vehicle handle assemblies will encounter simultaneous loading from users.

In this example, the handle cover 58 is a polymer-based material. The handle cover 58 clips to the handle core 54 to enclose the switches 126 within the respective vehicle handle assembly 26. When the handle cover 58 is clipped to the handle core 54, the switches 126 are enclosed within a cavity provided between the handle cover 58 and the handle core 54. The handle cover 58 can thus help to protect the switches 126 from environmental elements, such as dust, rain, and snow.

The cavity can house other components in addition to the switches 126. In the exemplary embodiment, the cavity houses a sensor assembly 134 that is used to detect objects near the powered closure assembly 14. Detecting such objects can be useful as these objects could interfere moving the powered closure assembly 14 with the actuators 18. The sensor assembly 134 can, for example, detect a curb that is within an opening path of the powered closure assembly 14. In response to receiving a signal from the sensor assembly 134 indicating that the curb is within the opening path of the powered closure assembly 14, the controller module 128 can override the input from the switches 126 and refuse to command the actuators 18 to automatically open the powered closure assembly 14.

The sensor assembly 134, in the exemplary embodiment is a 15×15 millimeter short range RADAR sensor assembly. In addition to detecting objects near the powered closure assembly 14, the sensor assembly 134, in some example, can be configured to detect gestures made by the user. The gestures, such as hand gestures, can trigger the controller module 128 to command the actuator to open or close the side door, or to otherwise control operation of the powered closure assembly 14.

The sensor assembly 134 mounts to the outwardly facing surface 130 of the outer wall 110. The outwardly facing surface 130, in the exemplary embodiment, is disposed on a vertical plane. The exemplary sensor assembly 134 is thus mounted to a vertical surface and is oriented perpendicular to ground. This orientation can facilitate directing the cone of coverage for the sensor assembly 134 into desire areas.

Placing the sensor assembly 134 on the outwardly facing surface 130 of the outer wall 110 rather than, for example, the forward pillar 30, means that the sensor assembly 134 is moved further laterally outward away from the outer panel 82. The sensor assembly 134 can then project a cone of coverage downward and closer to the vehicle 10 reducing the potential for the outer panel 82 interfering with the cone of coverage. This can facilitate the detecting, for example, the aforementioned curb, without the outer panel interfering.

The powered closure assembly 14 can include an antenna module 138 within or behind an applique of the rear pillar 34. In another example, the antenna module 138 resides within or behind an applique of the forward pillar 30. The antenna module 138 can be used to detect an authorized device near the vehicle, such as a keyfob or smartphone carried by the user. The controller module 128 may initiate the automatic transition of the powered closure assembly 14, or an unlatching of the powered closure assembly 14, only if the antenna module 138 detects an authorized user device.

The antenna modules 138 can be low frequency antenna modules such as Bluetooth Low Energy Antenna Modules (BLEAMs). The polymer based construction of the handle core 54 and the handle cover 58 can help to reduce the vehicle handle assembly 26 potentially interfering with communications to and from the antenna modules 138. Keeping the antenna module 138 outside the vehicle handle assembly 26 can further facilitate reducing a size of the vehicle handle assembly 26.

Some features of the disclosed embodiments include a vehicle handle assembly that is relatively small, which may be desirable for aesthetic purposes. The vehicle handle assembly includes switches that can trigger movement of a powered closure assembly. The vehicle handle assembly can house sensors at a position spaced laterally outward away from the powered closure assembly.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A vehicle handle assembly, comprising:

an attachment bracket secured to a powered closure assembly of a vehicle;

a handle core that is mounted to the attachment bracket, the handle core including an opening extending from a vertically upward facing surface of the handle core to a vertically downward facing surface of the handle core wherein the handle core extends about an entire circumferential perimeter of the opening;

at least one switch mounted to the handle core, the at least one switch configured to transition from a first state to a second state in response to a user grasping the handle core, the powered closure assembly moveable between a first position and a different, second position in response to a transition of the at least one switch; and a handle cover that is secured to the handle core to enclose the at least one switch in a cavity between the handle cover and the handle core, wherein the powered closure assembly is a vehicle side door, wherein the vehicle side door defines a window opening between a forward pillar portion and a rear pillar portion, and wherein the vehicle side door further comprises a belt molding disposed vertically below the window opening, the handle core vertically aligned with the belt molding.

2. The vehicle handle assembly of claim 1, wherein the vehicle side door includes a panel, the attachment bracket hooked over a vertically upper edge of the panel.

3. The vehicle handle assembly of claim 1, further comprising an actuator that moves the vehicle side door from the first position and the different, second position in response to the at least one switch transitioning from the first state to the second state.

4. The vehicle handle assembly of claim 1, further comprising an antenna module disposed in the forward pillar portion or the rear pillar portion, the antenna module configured to detect a signal from an authorized device.

5. The vehicle handle assembly of claim 1, wherein the at least one switch comprises a load cell switch.

6. The vehicle handle assembly of claim 1, further comprising a RADAR sensor assembly within the cavity.

7. The vehicle handle assembly of claim 1, wherein the handle core is entirely a polymer-based material.

8. The vehicle handle assembly of claim 7, wherein the attachment bracket is entirely a metal or metal alloy.

9. The vehicle handle assembly of claim 8, wherein the handle core is overmolded to the attachment bracket.

10. The vehicle handle assembly of claim 1, wherein the at least one switch is mounted to an outer wall of the handle core, the at least one switch mounted to an area of the outer wall that is thinned relative to another area of the outer wall.

11. A vehicle powered closure actuating method, comprising:

providing at least one switch mounted to a handle core, the handle core mounted to an attachment bracket that is secured to a powered closure assembly of a vehicle, wherein a handle cover is secured to the handle core to enclose the at least one switch within a cavity between the handle cover and the handle core;

transitioning the at least one switch from a first state to a second state in response to a user grasping the handle core, wherein the handle core includes an opening extending from a vertically upward facing surface of the handle core to a vertically downward facing surface of the handle core, wherein the at least one switch transitions in response to a user applying pressure to a side of the handle core that faces the opening, wherein the handle core extends about an entire circumferential perimeter of the opening; and in response to the transitioning, initiating a powered movement of the powered closure assembly between a less open position and a more open position, wherein the powered closure assembly is a vehicle side door, wherein the vehicle side door defines a window opening between a forward pillar portion and a rear pillar portion, and wherein the vehicle side door further comprises a belt molding disposed vertically below the window opening, the handle core vertically aligned with the belt molding.

12. The vehicle powered closure actuating method of claim 11, wherein the at least one switch comprises a load cell switch.

13. A vehicle handle assembly, comprising:

an attachment bracket secured to a powered closure assembly of a vehicle;

a handle core that is mounted to the attachment bracket, the handle core including an opening extending from a vertically upward facing surface of the handle core to a vertically downward facing surface of the handle core, the handle core including an inner wall, an outer wall, a forward wall, and a rear wall that establish a circumferentially continuous perimeter of the opening;

a handle cover that is secured to the handle core; and at least one switch enclosed within a cavity between the handle cover and the handle core, the at least one switch mounted to an outwardly facing surface of the outer wall of the handle core, the at least one switch mounted to an area of the outer wall that is thinned relative to another area of the outer wall, the at least one switch configured to transition from a first state to a second state in response to a user grasping the handle core, the powered closure assembly moving between a first position and a different, second position in response to a transition of the at least one switch, wherein the powered closure assembly is a vehicle side door, wherein the vehicle side door defines a window opening between a forward pillar portion and a rear pillar portion, wherein the vehicle side door further comprises a belt molding disposed vertically below the window opening, the handle core vertically aligned with the belt molding.

14. The vehicle handle assembly of claim 13, wherein the at least one switch is at least one load cell switch.

15. The vehicle handle assembly of claim 13, further comprising at least one sensor mounted to the area of the outer wall that is thinned.

* * * * *